US005711095A

United States Patent [19]

Oda et al.

[11] Patent Number: 5,711,095

[45] Date of Patent: Jan. 27, 1998

[54] HYDRAULIC WORKING MACHINE HAVING A PROJECTING PORTION

[75] Inventors: Kazuo Oda; Yoshiaki Murakami, both of Hiroshima; Masaaki Terada, Ogaki, all of Japan

[73] Assignee: Kabushiki Kaisha Kobe Seiko Sho, Kobe, Japan

[21] Appl. No.: 645,713

[22] Filed: May 14, 1996

[51] Int. Cl.[6] ..... E02F 3/96

[52] U.S. Cl. ..... 37/410; 37/443; 37/379; 180/327; 180/329

[58] Field of Search ..... 37/379, 403, 410, 37/418, 442, 443, 444, 445; 172/300; 180/326, 329, 331, 327

[56] References Cited

U.S. PATENT DOCUMENTS

| | | | |
|---|---|---|---|
| 4,102,461 | 7/1978 | Soyland | 37/379 X |
| 4,444,542 | 4/1984 | Shaw et al. | 37/379 X |
| 4,541,161 | 9/1985 | Shimoie | 37/379 X |
| 4,771,855 | 9/1988 | Takashima et al. | 180/329 X |
| 5,007,882 | 4/1991 | Mizumoto et al. | 37/443 |
| 5,195,863 | 3/1993 | De Pingon | 37/379 X |
| 5,367,796 | 11/1994 | Bowers et al. | 37/410 |
| 5,596,824 | 1/1997 | Scott et al. | 37/403 |

FOREIGN PATENT DOCUMENTS

| | | | |
|---|---|---|---|
| 4136392 | 5/1992 | Germany | 37/379 |
| 55-159027 | 12/1980 | Japan | 37/410 |
| 62-148725 | 7/1987 | Japan . | |
| 5-118001 | 5/1993 | Japan | 37/379 |
| 5-125744 | 5/1993 | Japan . | |
| 2 184 419 | 6/1987 | United Kingdom . | |

OTHER PUBLICATIONS

Patent Abstracts of Japan, vol. 95, No. 001, JP-A-07 018701, Jan. 20, 1995.

Patent Abstracts of Japan, vol. 95, No. 005, JP-A-07 0127100, May 16, 1995.

*Primary Examiner*—Terry Lee Melius
*Assistant Examiner*—Victor Batson
*Attorney, Agent, or Firm*—Oblon, Spivak, McClelland, Maier & Neustadt, P.C.

[57] ABSTRACT

A hydraulic excavator includes a revolving upper structure having a rear half swingable within the width of the machine. The revolving upper structure has a front portion on which a cab is disposed. An internal combustion engine is mounted in the rear of the cab. Various components including a direction control valve, a hydraulic oil tank, and a fuel tank are mounted alongside the cab. The revolving upper structure has a front end portion supporting thereon a bracket, and a boom pivotally mounted on the bracket for undertaking a swing motion within an angular range of an angle less than 180°. The swing angle is so set as to extend over a greater extent on one side located close to the cab than on the other side remote from the cab. The revolving upper structure further includes a projecting portion swelling out into an area kept out of the swing range of the boom. With the projecting portion thus provided, an internal space of the revolving upper structure available for mounting various components can be enlarged.

9 Claims, 5 Drawing Sheets

HYDRAULIC WORKING MACHINE HAVING A PROJECTING PORTION

BACKGROUND OF THE INVENTION

1. Field of the Invention

The present invention relates to a hydraulic working machine such as a hydraulic excavator.

2. Description of the Related Art

Known hydraulic excavators include a mobile lower structure or undercarriage and a revolving upper structure rotatably mounted on the undercarriage A driver's cab is provided on one side of a front portion of the revolving upper structure, and an internal combustion engine is mounted in a rear portion of the revolving upper structure. The, revolving upper structure is also provided with a directional control valve for activating various hydraulic cylinders, such as a boom hydraulic cylinder, and a swing hydraulic motor, a hydraulic oil tank, and a fuel tank for the internal combustion engine. The hydraulic cylinders are operated according to the movement or position of control levers provided in the cab.

The conventional hydraulic working machines of the type concerned has a drawback that while the upper structure is rotating, a rear end portion of the upper structure projects from the overall width of the machine, making it difficult to continue the underlying work in a limited or narrow working area. To deal with this problem, there has been proposed a hydraulic working machine including a revolving upper structure constructed such that a rear half of the upper structure is movable within the overall width of the machine while the upper structure is rotating. Since the rear half of the upper structure has a movable area substantially contained in a circle having a diameter equal to the overall width of the machine, it does not project from the overall width of the machine while the upper structure is rotating. Accordingly, the proposed hydraulic working machine is able to perform the necessary work in a limited or narrow area without difficulty.

However, due to the necessity of limiting the movable area of an upper support rear half within the circle drawn by the entire width of the machine, the rear half of the upper structure has a limited space available for mounting the components mentioned above. This problem (reduction in mounting space of the rear half) becomes critical for small-sized hydraulic excavators generally designed for use in a limited or narrow work space. In other words, the rear half having a reduced mount space is insufficient to contain all of the tanks, the engine and the directional control valve.

It may be considered that the fuel tank, which can be changed in shape with no great difficulty, be downsized to enlarge the space provided for mounting other components. However, downsizing of the fuel tank would bring about an increased number of refuelings, resulting in a low operation efficiency. In addition, since the shape of the directional control valve the hydraulic oil tank or the internal combustion engine has a certain limitation in view of the performance achieved, a change or modification of the shape will incur an additional cost.

SUMMARY OF THE INVENTION

It is accordingly an object of the present invention to provide a hydraulic working machine which is capable of retaining a sufficient mount space for various components while maintaining a high operation efficiency.

According to a preferred embodiment of the present invention, there is provided a hydraulic working machine which comprises: an undercarriage; a revolving upper structure rotatably mounted on the undercarriage and including a cab; a swing boom of which swing area extending over a greater extent on one side located close to the cab than on the other side remote from the cab; and a projecting portion provided on the upper structure. The projecting portion is provided outside the swing area.

It is preferable that the angle of the swing area of the boom is substantially equal to 140°. In this instance, an angular range of the swing angle is preferably 90°–85° on the cab side, and 55°–50° on the other side.

The projecting portion may be used for receiving therein a fuel tank. The projecting portion can be used also as an access platform or deck. As a preferred alternative, a multicontrol valve may be disposed in the projecting portion. To the projecting portion is fixed a bracket for supporting thereon the boom.

In a small-sized hydraulic excavator or the like hydraulic working machine designed for use in a limited or narrow working area, a boom horizontally swingably mounted on a front end of the revolving upper structure constitutes a major requirement for achieving a gutter cutting operation; However, in the case where the cab is disposed on one side of a front portion of the upper structure, the boom while moving in an area remote from the cab side has a poor visibility and, hence, the operator finds difficulty in manipulating the boom. Through an investigation, the present inventors perceived that the forgoing difficulty could be removed when the boom swung over a greater extent within an area having a better visibility.

According to the present invention, such a poor visibility area is excluded from the range of swinging movement of the boom and utilized for providing a projecting portion instead. With the projecting portion thus provided, the internal space of the upper structure which is available for mounting various components can be increased. The boom may be supported at a position which is off center from a longitudinal centerline of the upper structure to the side remote from the cab. In this instance, the boom itself does never constitute an obstacle against the field of view of the operator.

In the case where the fuel tank, which has a high degree of design freedom, is disposed in the projecting portion in such a manner as to follow the profile of the projecting portion, various components can be mounted in the revolving upper structure without causing a reduction in capacity of the fuel tank. Furthermore, the access deck provided on the projecting portion enables the operator to set on and off the cab from the side other than the cab side, The access deck thus forms a wide walk-through access platform. By utilizing the projecting portion as a space for mounting the fuel tank and also as an area providing the access deck, the internal space of the upper structure which is available for mounting other various components can be enlarged to such an extent that a swing hydraulic cylinder used for swinging the boom can be disposed beneath the cab, and the boom can undertake a swing motion smoothly over the entire swing range or angle. In addition, since the bracket may be fixed to the projecting portion, the distance between a pivot axis of the boom and a base portion of the bracket can be reduced. This arrangement increases the strength of the bracket.

By virtue of an additional space provided by the projecting portion, the movable area of the rear half of the revolving upper structure can be limited well within the width of the machine even when the existing tanks, engine and directional control valve are all mounted in the upper structure. Since the rear half of the upper structure is swingable within the width of the machine, a considerable reduction in overall size of the upper structure can be attained.

The above and other object, features and advantages the present invention will become manifest to those versed in the art upon making reference to the detailed description and accompanying sheets of drawings in which preferred structural embodiments incorporating the principles of the present invention are shown by way of illustrative example.

DESCRIPTION OF THE PREFERRED EMBODIMENTS

Certain preferred structural embodiments of the present invention will be described below in greater detail with reference to the accompanying sheets of drawings.

Figure 1:
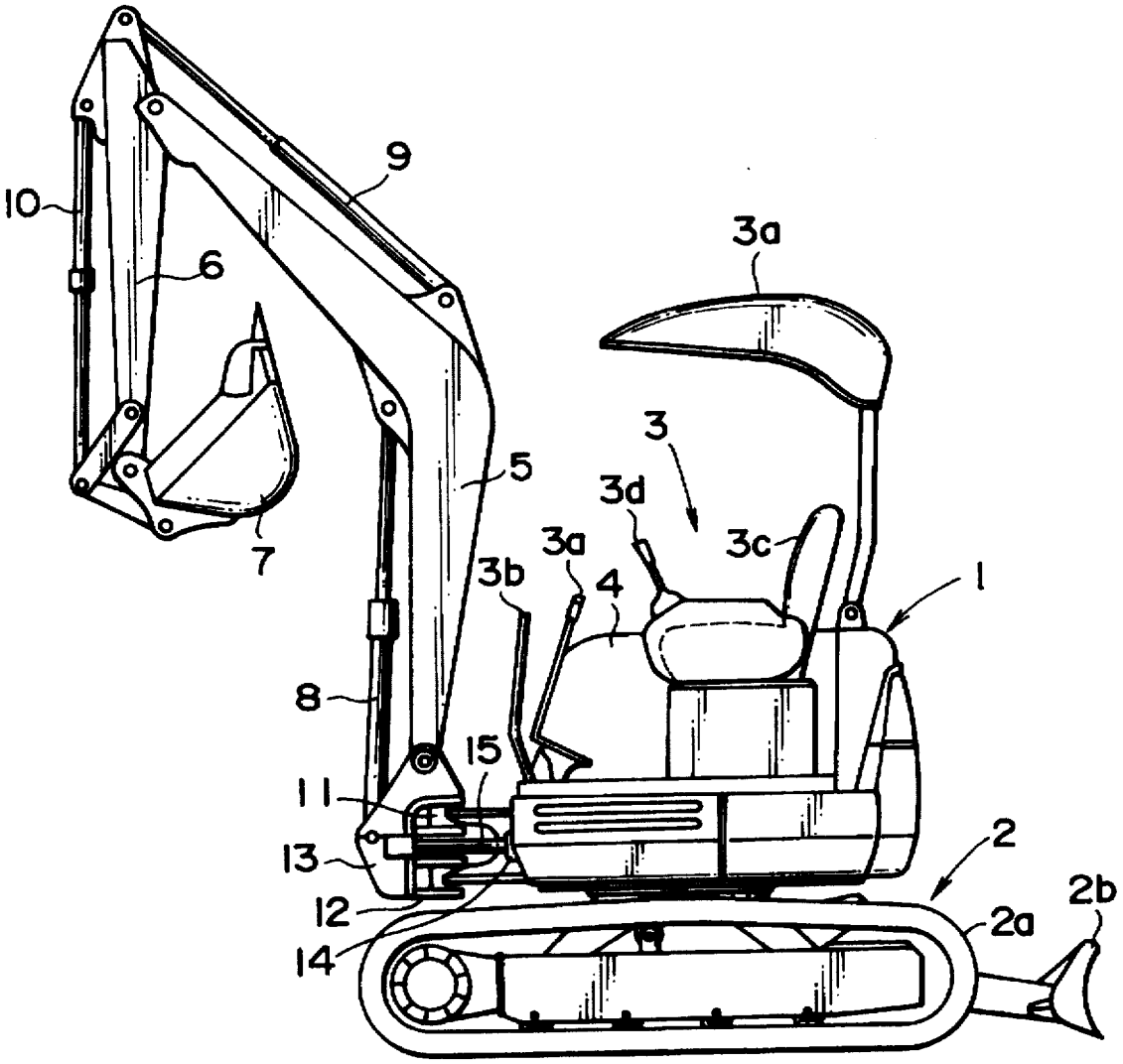
FIG. 1 is a left side view of a hydraulic excavator according to the present invention.

FIG. 1 shows the general construction of a hydraulic excavator (hydraulic working machine) according to the present invention. The hydraulic working machine of the present invention is a small-sized hydraulic excavator particularly suitable for use in a limited or narrow working area. The small-sized hydraulic excavator includes a revolving upper structure 1 rotatably mounted on a mobile lower structure or undercarriage 2. The revolving upper structure 1 has a driver's cab 3 provided on a left side of a front portion of the upper structure 1. The revolving upper structure 1 further includes a housing 4 so constructed as to surround a right side and a rear side of a lower portion of the cab 3 and contains various apparatus described later on.

The revolving upper structure 1 has a front end from which a boom 5, an arm 6, and a bucket 7 extend in the order named. The boom 5, the arm 6 and the bucket 7 are pivotally movable in a vertical plane by means of a boom hydraulic cylinder 8, an arm hydraulic cylinder 9, and a bucket hydraulic cylinder 10, respectively. In the illustrated embodiment, the boom 5 is pivotally mounted on a vertical post 11 disposed on the front end of the revolving upper structure 1 so that the boom 5 can swing or revolve about the vertical post 11 in the leftward and rightward directions of the upper structure 1. In FIG. 1, reference characters 3*a* denotes a canopy, 3*b* a handrail, 3*c* a seat, and 3*d* control levers, these components 3*a*–3*d* constituting the cab 3. Similarly, reference character 2*a* denotes a crawler, and 2*b* a dozer, these components 2*a*, 2*b* constituting the undercarriage 2.

Figure 2:
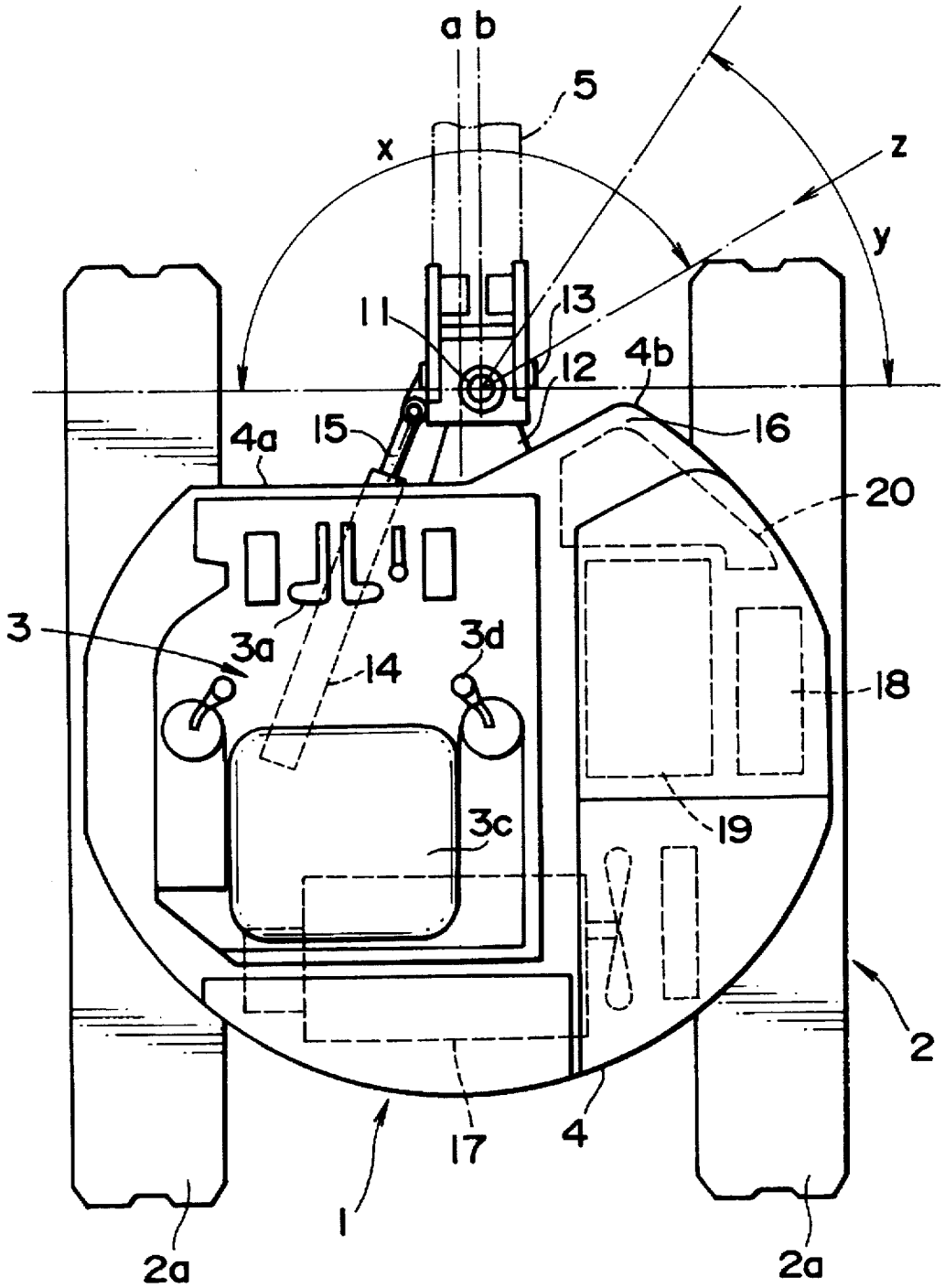
FIG. 2 is a diagrammatical plan view showing a revolving upper structure according to a first embodiment of the present invention.

Referring now to FIG. 2, a first embodiment of the present invention will be described later in greater detail. The housing 4 has a shape in the plan view which is substantially received within a circle having a diameter equal to the entire width of the machine or vehicle. Particularly, a rear half of the housing 4 has a shape completely received within same circle. Accordingly, the rear half of the housing 4 does never project from the overall width of the machine while the upper structure 1 is rotating. The front portion of the revolving upper structure 1 is formed with a flat portion 4*a* located in front of the cab 3, and a projecting portion or protuberance 4*b* contiguous to the portion 4*a* and projecting or swelling out to the front right of the cab 3. The flat portion 4*a* and the projecting portion 4*b* have a junction or common boundary on and in the vicinity of which a bracket 12 is fixedly mounted for supporting thereon the boom 5 via the post 11.

The boom 5 is pivotally mounted on the post 11 via a boom mount 13. The post 11 is supported on the front end of the bracket 12 at a position which is displaced or off center by a predetermined distance from a longitudinal centerline a of the revolving upper structure 1 toward a side which is remote from the cab 3. The bracket 12 projects from the front end of the revolving upper structure 1. Due to the provision of the projecting portion 4*b*, the post 11 and a base portion of the bracket 12 fixed to the upper structure 1 are located close to each other with the result that the strength of the bracket 12 can be increased.

A swing hydraulic cylinder 14 for oscillating or swinging the boom 5 about the vertical post 11 to the leftward and rightward directions of the revolving upper structure 1 is disposed below the cab 3 of the revolving upper structure 1 and extends substantially in the longitudinal direction of the revolving upper structure 1. The swing hydraulic cylinder 14 has a rear end pivotally connected to the revolving upper structure 1 and includes a piston rod 15 having an outer end pivotally connected to the boom mount 13. With this arrangement, when the swing hydraulic cylinder 14 is activated to extend and contract (i.e., reciprocate) the piston rod 15, the boom 5 oscillates relative to the revolving upper structure 1 in the clockwise and counterclockwise directions about the post 11. During that time, the swing hydraulic cylinder 14 oscillates about its pivoted rear end.

The boom 5 has a swing range x (boom swing angle= 140°) which is deigned between a first position of the boom 5 in which the boom 5 extends parallel to the flat portion 4*a*, and a second position of the boom 5 in which the boom 5 extends diagonally to the front right of the cab 3 at an angle with respect to the flat portion 4*a* such that a sufficient operation efficiency can be maintained. The swing range x thus defined partly eliminate an area of poor visibility (a angular range indicated by y (about 55°)) which is present in the conventional hydraulic excavator over the front right side of the cab 3.

During digging operation achieved to cut a gutter, the boom 5 is swung or turned so as to place the bucket 7 to a position outside the width of the machine. In this connection, the boom swing angle x is determined such that the boom 5 can be located at one side of the vehicle body (machine body) while it is kept parallel to the longitudinal axis of the machine body even when the gutter to be cut extends alongside a relatively tall obstacle, such as a fence, which cannot be overridden by the hydraulic excavator.

Though not shown but it occurs in practice that the boom 5 swings leftwards at the same time as the upper structure 1 swings rightwards, or alternatively, the boom 5 swings rightwards at the same time as the upper structure 1 swings leftwards. With this combined angular movement, the bucket 7 can be moved in the widthwise (transverse) direction of the machine while the boom 5 is kept parallel to the longitudinal axis of the machine. The bucket 7 can, therefore, be set in a desired position during the gutter cutting operation.

In the case where the bucket 7 is moved in the transverse direction of the machine while keeping the boom 5 in a condition extending parallel to the longitudinal axis of the machine, the swing angle of the boom 5 has a close relationship to the distance between a swing axis of the upper structure 1 and an axis of the post 11; that is, the distance between the swing axis of the upper structure 1 and the axis of the poet 11 can be reduced with an increase in the swing angle of the boom 5. By increasing the boom swing angle, the boom 5, which is subjected to a relatively heavy load, can be arranged much closer to the swing axis of the upper structure 1. This arrangement offers an increased degree of stability to the upper structure 1.

In the first embodiment described above, the swing angle of the boom 5 is relatively large and precisely 140° with the result that the boom 5 can be pivoted at a position capable of insuring high stability of the upper structure 1. The swing angle 140° of the boom 5 is divided by a reference line b extending longitudinally of the upper structure 1 through the axis of the post 11, into two portions; a first portion 90° on the cab 3 side, and a second portion 50° on the other side remote from the cab 8. With this portioning of the boom swing angle, the operator is able to avail oneself of a wider boom swing range (i.e., the first portion of 90°) extending in an operation area of good visibility. Thus, the overall operation efficiency can be increased.

As previously described, the post 11 of the boom 5 is supported on the bracket 12 at a position which is offset from the longitudinal centerline a of the upper structure 1 in a direction away from the cab 3, the boom 5 itself does never constitute an obstruction against the field of view of the operator. The portioning of the swing angle 140' of the boom 5 should preferably be achieved such that the operator can avail oneself of a greater portion of the boom swing angle extending in an operation area of maximum visibility. For example, though not shown, the boom swing angle 140° may be divided into a first portion 85° on the cab 3 side of the reference line b and a second portion 55° on the opposite side of the reference line b from the cab 3. The swing angle of the boom 5 should by no means be exactly equal to 140° but may be somewhat smaller than or greater than 140°.

By virtue of the swing range x so determined as described above, there is a position which is located at the front right side of the cab 3 and which is held out of interference with the boom 5. The projecting portion 4*b* is provided at this position. The projecting portion 4*b* has one side extending parallel to the boom 5 when the boom 5 is located at the right end z of its swing range x. The projecting portion 4*b* is so designed as to swell out from the flat portion 4*a* as much as possible within a range in which the projecting portion 4*b* makes no contact or interfere with the boom 5. The projecting portion 4*b* thus provided increases the outside shape or profile in the plan view of the housing 4.

The projecting portion 4*b* is formed with a walk-through access platform or deck 16 extending obliquely from the periphery of the upper structure 1 toward the cab 3 along one side of the projecting portion 4*b* so that the operator can get on and off the cab 3 from the right side of the machine.

The housing 4 including the projecting portion 4*b* houses or contains various apparatus, such as an internal combustion engine 17, a directional control valve 18, a hydraulic oil tank 19, and a fuel tank 20.

The internal combustion engine 17 is mounted in the revolving upper structure 1 at a position located rearward of the cab 3. The internal combustion engine 17 is arranged transversely of the revolving upper structure 1 with its crankshaft (not shown) aligned with the transverse direction (widthwise or lateral direction) of the revolving upper structure 1. The internal combustion engine 17 is provided with a cooling fan (not designated) and a radiator (not designated) that are disposed on the right side of the engine 17, and also with a hydraulic pump (not designated) which is disposed on the left side of the engine 17 and driven by the engine 17. The directional control valve 18 is mounted in the housing 4 at a front position of the revolving upper structure 1 adjacent to the right sidewall of the revolving upper structure 1 and arranged longitudinally of revolving the upper structure 1 with its longitudinal axis aligned with the longitudinal direction of the revolving upper structure 1. The directional control valve 18 is disposed close to the cooling fan (not designated) of the internal combustion engine. The fuel tank 20 and the hydraulic oil tank 19 are mounted in the housing 4 at a position between the directional control valve 18 and the cab 3, with the fuel tank 20 located forwardly of the hydraulic oil tank 19 in the longitudinal direction of the revolving upper structure 1. The fuel tank 20 is easy to manufacture and can be molded with a high degree of design freedom. Accordingly, as shown in FIG. 2, the fuel tank 20 is configured such that a portion of the fuel tank 20 has a shape complementary in contour to the shape of the projecting portion 4*b* including the walk-through access deck 16. This portion of the fuel tank 20, as shown in FIG. 8, is recessed to follow the shape of the walk-through access deck 16 and extends beneath the walk-through access deck 16. The fuel tank 20 can be received in the housing 4 with no reduction in its capacity.

Since the fuel tank 20 is received in that portion of the housing 4 including the projecting portion 4*b*, the hydraulic oil tank 19, the directional control valve 18 and the internal combustion engine 17 can be readily installed in the revolving upper structure 1 even though the movable area of the rear half of the upper structure 1 is limited well within a circle having a diameter equal to the width of the machine. No change or modification of the standard specification is necessary at all with respect to these components 17–19.

Though not shown, a swing hydraulic motor for revolving the revolving upper structure 1 by means of a swing bearing, and a swivel joint for supplying a working fluid from the revolving upper structure 1 side to a traveling hydraulic motor in the undercarriage 2 are disposed in a central portion of the revolving upper structure 1 located below the cab 3.

It appears clear from the foregoing description that by virtue of the projecting portion 4*b*, the mount space available for installation of various components in the housing 4 of the revolving upper structure 1 is enlarged. Accordingly, the mounting layout of the various components should by no means be limited to the layout of the first embodiment just described above, but my be changed in various different manners.

A further description will be given of a second embodiment shown in FIG. 4, in which the illustrated hydraulic working machine (hydraulic excavator) is larger in width than the working machine of the first embodiment (see FIG. 3). In this hydraulic working machine having a larger width, the aforesaid components or apparatus can be mounted in a revolving upper structure 1 with no special change in specification achieved even though the movable area of a rear half of the upper structure 1 is limited well within the width of the machine. In the second embodiment, the internal mounting space of the revolving upper structure 1 is enlarged by a projecting portion or protuberance 4*b*, and an additional space provided by the projecting portion 4b is used for installation of an apparatus, such as a multicontrol valve 21 which is used to change or vary the communication pattern of the pipelines. The multicontrol valve 21 of this type is conventionally disposed below the cab 3. In contrast, according to the arrangement of the present invention, the multicontrol valve 21 is received in the projecting portion 4b. The multicontrol valve 21 can be readily accessible from the right side of the revolving upper structure 1 when the maintenance is necessary. Maintenance of the multicontrol valve 21 can be achieved easily with the presence of the cab 3 which should be removed in the case of the conventional arrangement.

Figure 3:
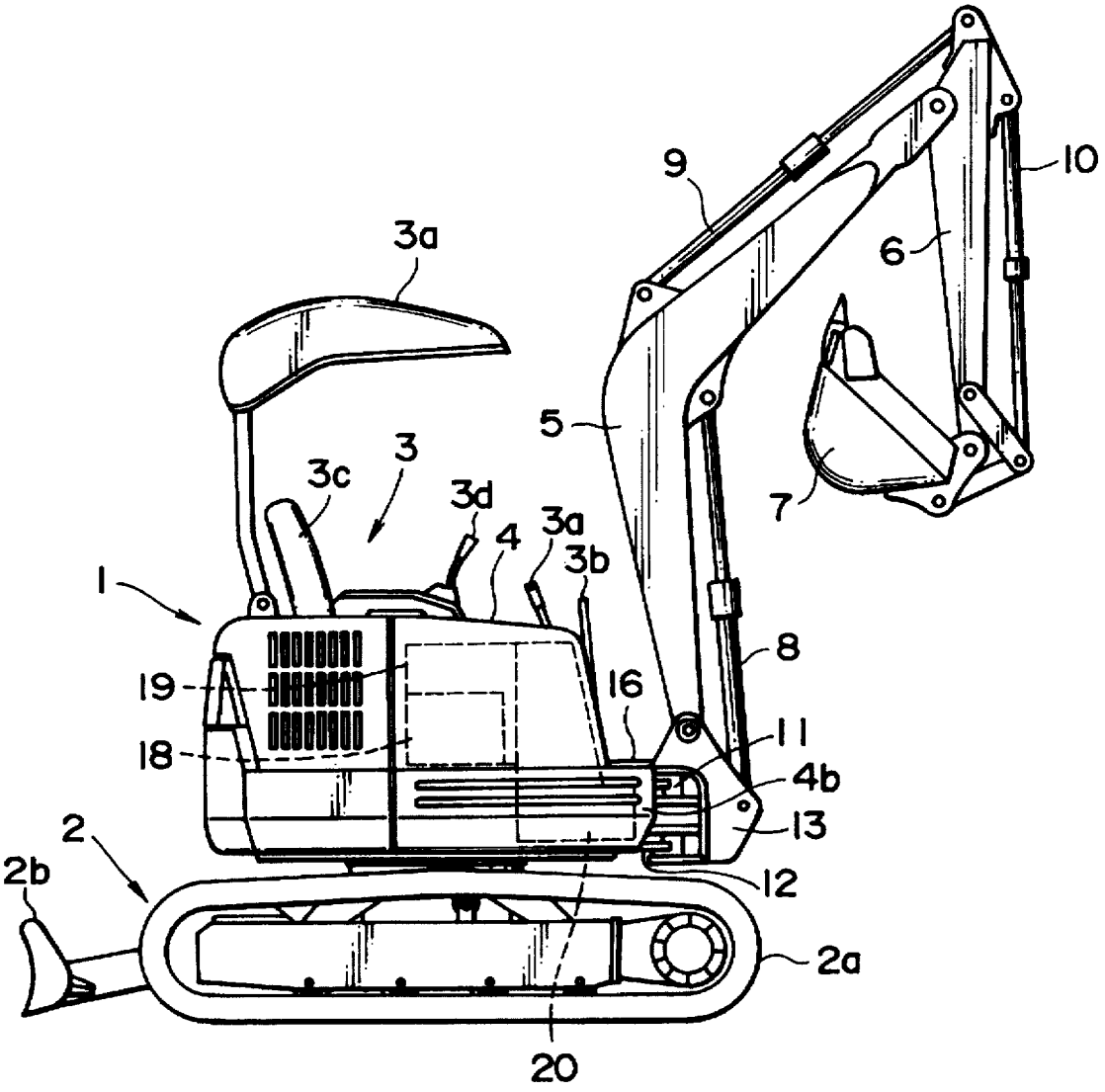
FIG. 3 is a fight side view of the hydraulic excavator.
Figure 4:
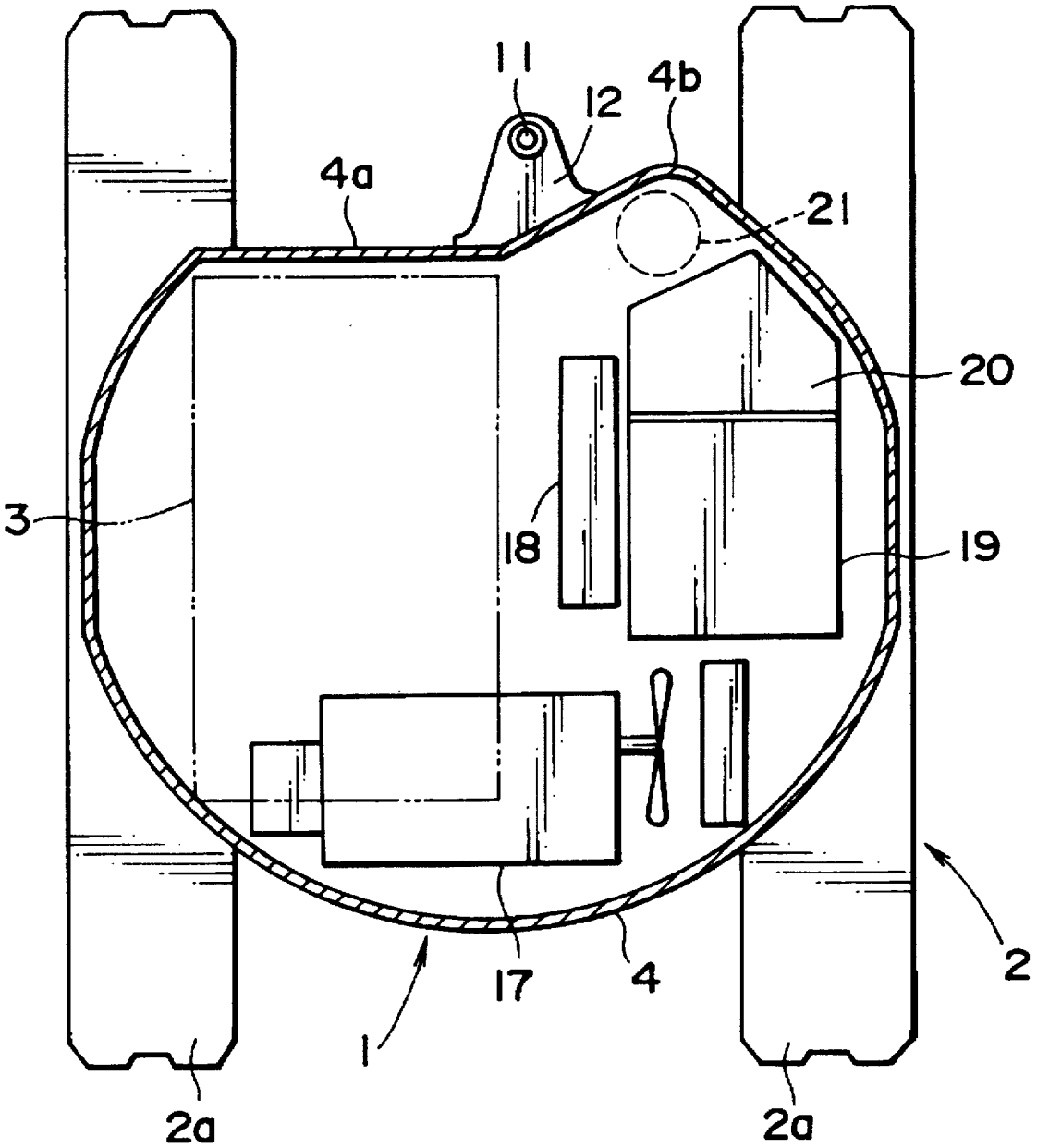
FIG. 4 is a diagrammatical plan view showing the layout of various apparatus mounted on a revolving upper structure of according to a second embodiment of the present invention.

Likewise the first embodiment shown in FIG. 3, the second embodiment includes a fuel tank 20 and a hydraulic oil tank 19 that are disposed in juxtaposition along the longitudinal direction of the revolving upper structure 1. On the other hand, a directional control valve 18 is disposed between the cab 3 and the tanks 20, 19. An internal combustion engine 17 is disposed in a rear portion of the revolving upper structure 1.

Then, a description will be given of a third embodiment shown in FIG. 5, in which the illustrated hydraulic working machine (hydraulic excavator) has a smaller width than the hydraulic working machine of the first embodiment shown in FIG. 3. In the hydraulic working machine of this smaller size, the internal space of a projecting portion 4b is used for mounting a fuel tank 20. In the third embodiment, a directional control valve 18 is disposed beneath the cab 3. With this arrangement, the present invention can be effectively applied even though the size of the revolving upper structure 1 is reduced.

Figure 5:
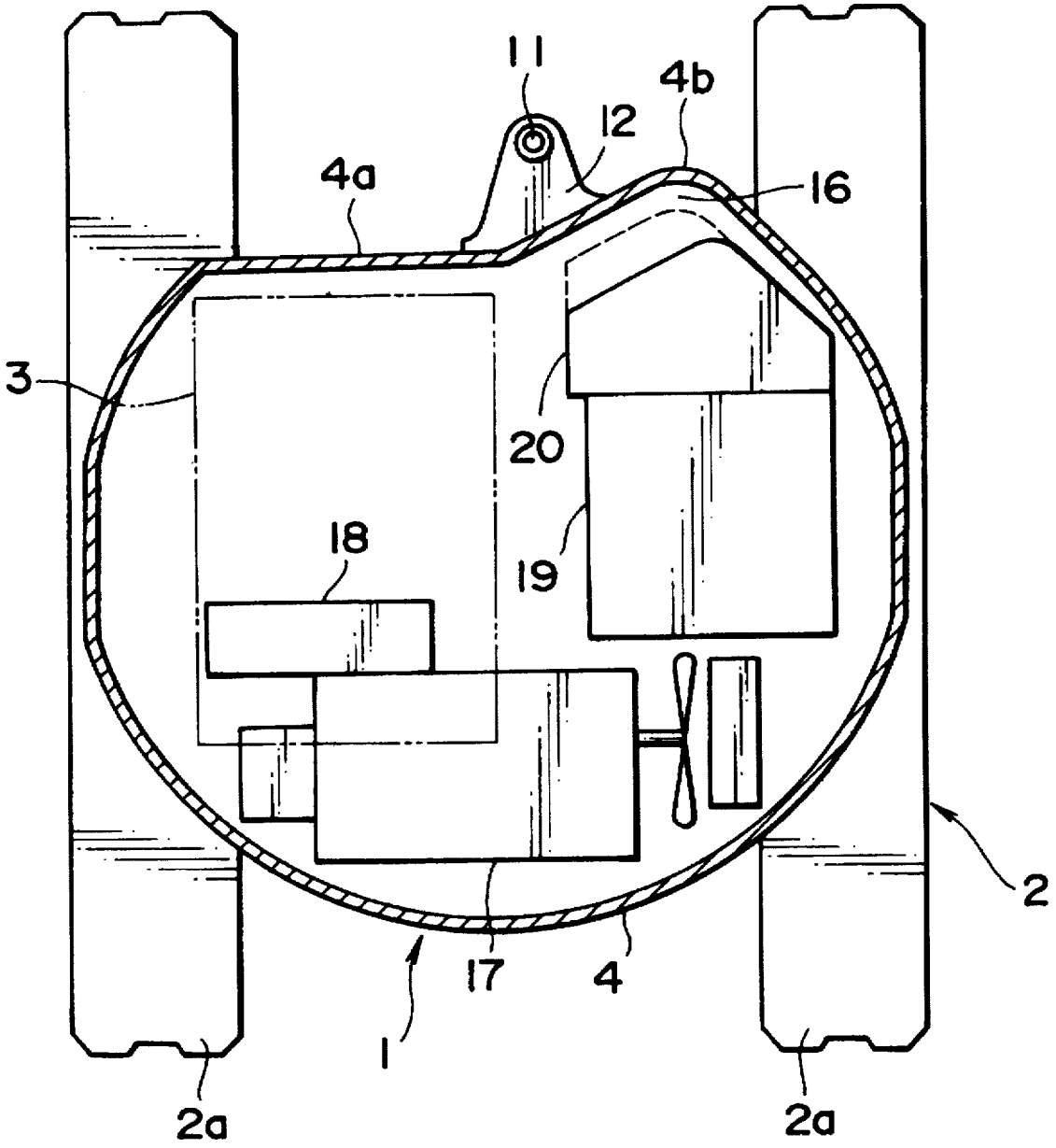
FIG. 5 is a diagrammatical plan view showing the layout of various apparatus mounted on a revolving upper structure according to a third embodiment of the present invention.

Turning to the arrangement of other components or apparatus, a hydraulic oil tank 19 is disposed in juxtaposition to the fuel tank 20 in the longitudinal direction of the upper structure 1, and an internal combustion engine 17 is disposed in a rear portion of the upper structure 1, as shown in FIG. 5. The fuel tank 20, like the tank in the first embodiment shown in FIG. 3, is so shaped as to partly protrude into the projecting portion 4b beneath a walk-through access platform or deck 16. The fuel tank 20 can be received in the housing 4 with no reduction in its capacity even though the movable area of the rear half of the upper structure 1 is limited well within a circle having a diameter equal to the width of the machine.

The cab 3 shown in each of the foregoing embodiments is of the "open" type with a seat exposed to the outside air, however, a cab of the cabin type my be employed in place of the disclosed open type cab 3.

Obviously, various minor changes and modifications of the present invention are possible in the light of the above teaching. It is therefore to be understood that within the scope of the appended claims the invention may be practiced otherwise than as specifically described.

What is claimed is:

1. A hydraulic working machine comprising:

an undercarriage;

a revolving upper structure rotatably mounted on said undercarriage and including a cab, said upper structure having a rear half movable within the width of said undercarriage while said upper structure is rotating;

a boom pivotally supported on a front end of said upper structure and being swingable within a swing area defined by a predetermined swing angle, said swing angle including a first end located near said cab and a second end located remote from said cab; and a projecting portion provided on said upper structure at a position remote from said cab and provided on an outside of said swing area, said projecting portion having a side surface facing said boom and extending substantially parallel to said boom when said boom is disposed at said second end of said swing angle.

2. A hydraulic working machine comprising:

an undercarriage;

a revolving upper structure rotatably mounted on said undercarriage and including a cab, said upper structure having a rear half movable within the width of said undercarriage while said upper structure is rotating;

a boom pivotally supported on a front end of said upper structure and being swingable within a swing area defined by a predetermined swing angle, said boom being supported at a position which is offset from a longitudinal centerline of said upper structure and is remote from said cab; and a projecting portion provided on said upper structure at a position remote from said cab and provided on an outside of said swing area, said projecting portion provided on a same side of said longitudinal centerline of said upper structure as is said boom pivot support position, said projecting portion having a side surface facing said boom when said boom is disposed at said outside of said swing area.

3. A hydraulic working machine according to claim 1, wherein said swing angle of said boom is substantially equal to 140°.

4. A hydraulic working machine according to claim 3, wherein an angle between the longitudinal centerline and said end being remote from said cab is 55°–50°.

5. A hydraulic working machine comprising:

an undercarriage;

a revolving upper structure rotatably mounted on said undercarriage and including a cab, said upper structure having a rear half movable within the width of said undercarriage while said upper structure is rotating;

a boom pivotally supported on a front end of said upper structure and being swingable within a swing area defined by a predetermined swing angle;

a projecting portion provided on said upper structure at a position remote from said cab and provided on an outside of said swing area; and a fuel tank, said fuel tank being disposed in said projecting portion.

6. A hydraulic working machine comprising:

an undercarriage;

a revolving upper structure rotatably mounted on said undercarriage and including a cab, said upper structure having a rear half movable within the width of said undercarriage while said upper structure is rotating;

a boom pivotally supported on a front end of said upper structure and being swingable within a swing area defined by a predetermined swing angle; and a projecting portion provided on said upper structure at a position remote from said cab and provided on an outside of said swing area; wherein said upper structure further has an access deck provided on said projecting portion and extending from an outside peripheral edge of said upper structure toward said cab.

7. A-hydraulic working machine according to claim 1, further including a swing hydraulic cylinder disposed beneath said cab for swinging said boom.

8. A hydraulic working machine comprising:

an undercarriage:

a revolving upper structure rotatably mounted on said undercarriage and including a cab, said upper structure having a rear half movable within the width of saint undercarriage while said upper structure is rotating;

a boom pivotally supported on a front end of said upper structure and being swingable within a swing area defined by a predetermined swing angle:

a projecting portion provided on said upper structure at a position remote from said cab and provided on an outside of said swing area; and a multicontrol valve, said multicontrol valve being disposed in said projecting portion.

9. A hydraulic working machine according to claim 1, further including a bracket fixed to said projecting portion, said boom being supported on said bracket.

* * * * *